US011017935B2

(12) United States Patent
Yamamoto

(10) Patent No.: US 11,017,935 B2
(45) Date of Patent: May 25, 2021

(54) REACTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Shinichiro Yamamoto, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 322 days.

(21) Appl. No.: 16/075,516

(22) PCT Filed: Feb. 1, 2017

(86) PCT No.: PCT/JP2017/003651
§ 371 (c)(1),
(2) Date: Aug. 3, 2018

(87) PCT Pub. No.: WO2017/135319
PCT Pub. Date: Aug. 10, 2017

(65) Prior Publication Data

US 2019/0122803 A1 Apr. 25, 2019

(30) Foreign Application Priority Data

Feb. 3, 2016 (JP) ..... JP2016-019195

(51) Int. Cl.
*H01F 27/02* (2006.01)
*H01F 37/00* (2006.01)
(Continued)

(52) U.S. Cl.
CPC ..... *H01F 27/022* (2013.01); *H01F 3/14* (2013.01); *H01F 27/255* (2013.01);
(Continued)

(58) Field of Classification Search
CPC .... H01F 27/02; H01F 27/022; H01F 27/2823; H01F 27/323; H01F 27/306; H01F 27/324; H01F 3/14
(Continued)

(56) References Cited

U.S. PATENT DOCUMENTS

2012/0126928 A1 5/2012 Yoshikawa et al.

FOREIGN PATENT DOCUMENTS

JP 2005302900 A * 10/2005
JP 2009027007 A * 2/2009
(Continued)

OTHER PUBLICATIONS

Mar. 7, 2017 International Search Report issued in International Patent Application No. PCT/JP2017/003651.

*Primary Examiner* — Tszfung J Chan
(74) *Attorney, Agent, or Firm* — Oliff PLC

(57) ABSTRACT

A reactor including a coil having a wound portion that is formed by winding a wire, a magnetic core having an inner core portion disposed inside the wound portion and an outer core portion disposed outside the wound portion, the inner and outer core portions forming a closed magnetic circuit, and an inner resin portion that joins an inner peripheral surface of the wound portion and an outer peripheral surface of the inner core portion to each other. The inner core portion includes a plurality of core pieces and gap portions that are constituted by a portion of the inner resin portion, the core pieces each including a gap-facing surface that faces a corresponding gap portion, a coil-facing surface that faces the inner peripheral surface of the wound portion, and a
(Continued)

notch-shaped resin flow portion at a corner portion between the gap-facing surface and the coil-facing surface.

4 Claims, 7 Drawing Sheets

(51) Int. Cl.

| | |
|---|---|
| ***H01F 27/34*** | (2006.01) |
| ***H01F 3/14*** | (2006.01) |
| ***H01F 27/30*** | (2006.01) |
| ***H01F 27/32*** | (2006.01) |
| ***H01F 27/255*** | (2006.01) |
| ***H01F 27/28*** | (2006.01) |
| ***H01F 41/06*** | (2016.01) |
| ***H01F 41/12*** | (2006.01) |

(52) U.S. Cl.
CPC ..... *H01F 27/2823* (2013.01); *H01F 27/306* (2013.01); *H01F 27/323* (2013.01); *H01F 27/324* (2013.01); *H01F 27/346* (2013.01); *H01F 37/00* (2013.01); *H01F 41/06* (2013.01); *H01F 41/127* (2013.01)

(58) Field of Classification Search
USPC ..... 336/178, 219, 212, 221
See application file for complete search history.

(56) References Cited

FOREIGN PATENT DOCUMENTS

| | | | | | |
|---|---|---|---|---|---|
| JP | 2011086801 | A | * | 4/2011 | |
| JP | 2011253982 | A | * | 12/2011 | |
| JP | 2013254929 | A | * | 12/2013 | ..... H01F 37/00 |
| JP | 2014-003125 | A | | 1/2014 | |
| JP | 2014003125 | A | * | 1/2014 | |
| JP | 2016-015389 | A | | 1/2016 | |
| WO | 2013/168538 | A1 | | 11/2013 | |
| WO | 2014/115672 | A1 | | 7/2014 | |

* cited by examiner

REACTOR

TECHNICAL FIELD

The present invention relates to a reactor.

This application is based upon and claims the benefit of priority from Japanese Patent Application No. 2016-019195 filed on Feb. 3, 2016, the entire disclosure of which is hereby incorporated by reference.

BACKGROUND ART

Patent Document 1 discloses a reactor that is formed by combining a coil, a magnetic core, and an insulating connecting member together and then filling the inside of a wound portion of the coil with a resin. It is considered that, with this configuration, the manufacturing process of the reactor can be simplified compared with a configuration in which the reactor is formed by covering a plurality of core pieces constituting the magnetic core with a resin and then combining the covered core pieces with the coil.

CITATION LIST

Patent Documents

Patent Document 1: JP 2014-003125A

SUMMARY

Technical Problem

The reactor disclosed herein is a reactor including:

a coil having a wound portion that is formed by winding a wire;

a magnetic core having an inner core portion that is disposed inside the wound portion and an outer core portion that is disposed outside the wound portion, the inner core portion and the outer core portion forming a closed magnetic circuit together; and an inner resin portion that joins an inner peripheral surface of the wound portion and an outer peripheral surface of the inner core portion to each other, wherein the inner core portion includes a plurality of core pieces and gap portions that are constituted by a portion of the inner resin portion, the core pieces each including:

- a gap-facing surface that faces a corresponding one of the gap portions;
- a coil-facing surface that faces the inner peripheral surface of the wound portion; and
- a notch-shaped resin flow portion that is provided at a corner portion between the gap-facing surface and the coil-facing surface.

DESCRIPTION OF EMBODIMENTS

Figure 1:
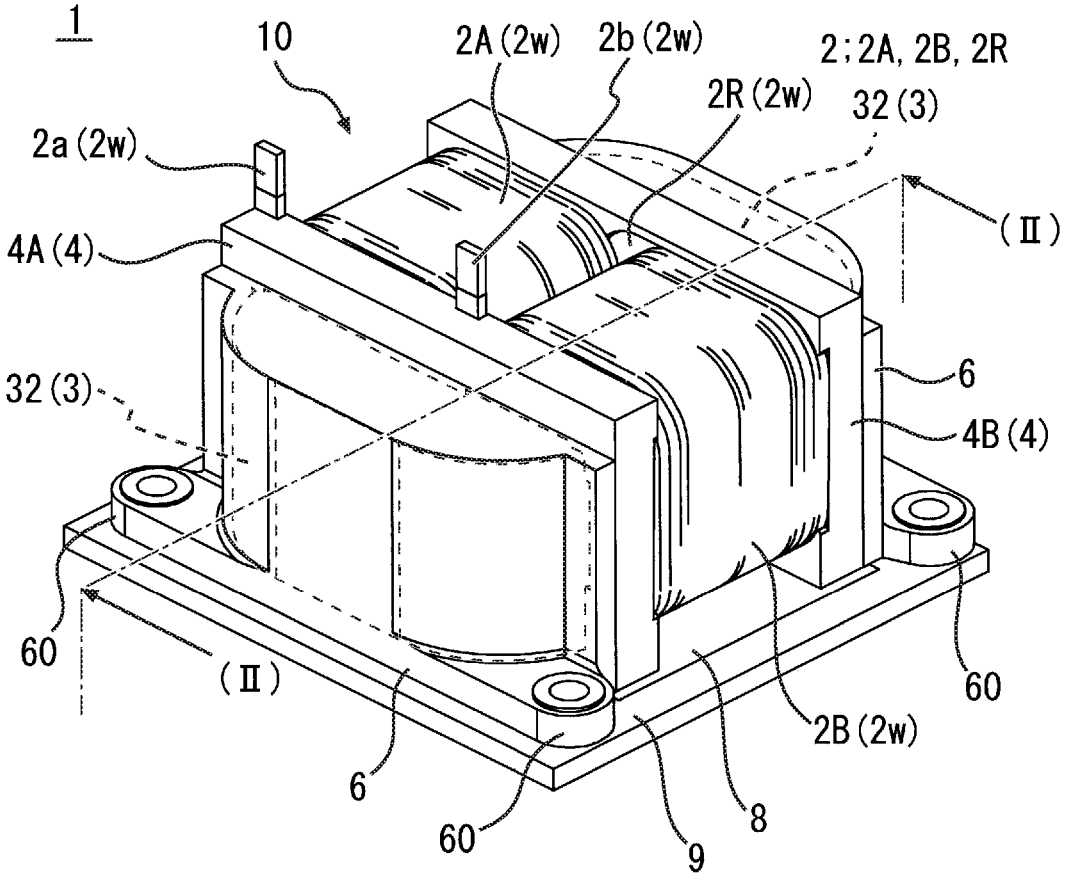
FIG. 1 is a schematic perspective view of a reactor according to Embodiment 1.

Problem to be Solved by the Present Disclosure

With the configuration disclosed in Patent Document 1, when a gap portion is to be formed between the core pieces using the resin with which the inside of the wound portion is filled, there are cases where the resin cannot be sufficiently filled into a space between the core pieces. If filling of the resin between the core pieces is insufficient, the core pieces inside the wound portion are likely to be loose, and thus may make noise, come into contact with each other, or come into contact with an inner peripheral surface of the wound portion.

To address this issue, an object of the present disclosure is to provide a reactor in which, even when a gap portion is formed between core pieces using a resin with which the inside of a wound portion is filled, the resin sufficiently fills a space between the core pieces.

Advantageous Effects of the Present Disclosure

According to the reactor of the present disclosure, a reactor can be obtained in which, even when a gap portion is formed between core pieces using a resin with which the inside of a wound portion is filled, the resin (inner resin portion) sufficiently fills a space between the core pieces.

DESCRIPTION OF EMBODIMENTS

A first embodiment will be listed and described.

<1> A reactor of an embodiment is a reactor including:

a coil having a wound portion that is formed by winding a wire;

a magnetic core having an inner core portion that is disposed inside the wound portion and an outer core portion that is disposed outside the wound portion, the inner core portion and the outer core portion forming a closed magnetic circuit together; and an inner resin portion that joins an inner peripheral surface of the wound portion and an outer peripheral surface of the inner core portion to each other, wherein the inner core portion includes a plurality of core pieces and gap portions that are constituted by a portion of the inner resin portion, the core pieces each including:

- a gap-facing surface that faces a corresponding one of the gap portions;
- a coil-facing surface that faces the inner peripheral surface of the wound portion; and
- a notch-shaped resin flow portion that is provided at a corner portion between the gap-facing surface and the coil-facing surface.

Since the resin flow portion is formed at a corner portion between the gap-facing surface and the coil-facing surface of each core piece, when a resin that is to constitute the inner resin portion is filled into the inside of the wound portion, the resin is likely to sufficiently penetrate spaces between the core pieces (including a space between a corresponding one of the core pieces and the outer core portion), the spaces constituting the gap portions. As a result, it is less likely that a large air gap will be formed at the positions of the gap portions of the reactor. That is to say, the reactor in which the core pieces include the resin flow portions is a reactor in which no large air gap is formed at the positions of the gap portions.

<2> With respect to the reactor of the embodiment, a mode is conceivable in which the resin flow portion is formed running all the way around an outer peripheral edge portion of the gap-facing surface.

Since the resin flow portion is formed running all the way around the outer peripheral edge portion of the gap-facing surface of each core piece, when the resin that is to constitute the inner resin portion is filled into the inside of the wound portion, the resin is likely to sufficiently penetrate the spaces between the core pieces, the spaces constituting the gap portions. As a result, it is less likely that a large air gap will be formed at the positions of the gap portions of the reactor.

<3> With respect to the reactor of the embodiment, a mode is conceivable in which, when viewed in a direction that is orthogonal to an axial direction of the wound portion, a width of the resin flow portion is larger than a width of the gap portions.

Since the width of the resin flow portion is larger than the distance between the core pieces, where the gap portions are formed, when the resin that is to constitute the inner resin portion is filled into the inside of the wound portion, the resin is likely to sufficiently penetrate the spaces between the core pieces, the spaces constituting the gap portions. As a result, it is less likely that a large air gap will be formed at the positions of the gap portions.

<4> With respect to the reactor of the embodiment, a mode is conceivable in which the coil includes an integrating resin that is provided separately from the inner resin portion and that integrates wire turns of the wound portion.

Since the wound portion is integrated using the integrating resin, when the resin that is to constitute the inner resin portion is filled into the inside of the wound portion, leakage of the resin from between wire turns can be suppressed. If leakage of the resin from between the wire turns can be suppressed, the resin is likely to sufficiently penetrate the spaces between the core pieces, the spaces constituting the gap portions, and consequently, it is less likely that a large air gap will be formed at the positions of the gap portions.

<5> With respect to the reactor of the embodiment, a mode is conceivable in which the core pieces are each composed of a powder compact made of a soft magnetic powder.

A powder compact can be manufactured with high productivity by compression molding a soft magnetic powder, and therefore, the productivity of a reactor that employs core pieces respectively composed of powder compacts can also be improved. Moreover, the ratio of the soft magnetic powder contained in the core pieces can be increased by the core pieces being each composed of a powder compact, and accordingly, the magnetic characteristics (relative permeability and saturation magnetic flux density) of the core pieces can be increased. Therefore, the performance of a reactor that employs core pieces composed of powder compacts can be improved.

<6> With respect to the reactor of the embodiment, a mode is conceivable in which the core pieces are each composed of a composite material containing a resin and a soft magnetic powder dispersed in the resin.

In the case of a composite material, it is easy to adjust the content of the soft magnetic powder in the resin. Therefore, it is easy to adjust the performance of a reactor that employs core pieces composed of a composite material.

DETAILS OF EMBODIMENTS

Hereinafter, embodiments of a reactor of the present invention will be described based on the drawings. In the drawings, like reference numerals denote objects having like names. It should be understood that the present invention is not to be limited to configurations described in the embodiments, but rather is to be defined by the appended claims, and all changes that come within the meaning and range of equivalency of the claims are intended to be embraced therein.

Embodiment 1

In Embodiment 1, a configuration of a reactor 1 will be described based on FIGS. 1 to 7. The reactor 1 shown in FIG. 1 includes an assembly 10 that is formed by combining a coil 2, a magnetic core 3, and an insulating connecting member 4 together, and a mount plate 9 on which the assembly 10 is mounted. The assembly 10 further includes inner resin portions 5 (see FIG. 2) that are disposed inside wound portions 2A and 2B of the coil 2, as well as outer resin portions 6 that cover outer core portions 32 that constitute a part of the magnetic core 3. Hereinafter, the various components included in the reactor 1 will be described in detail.

Assembly

Figure 2:
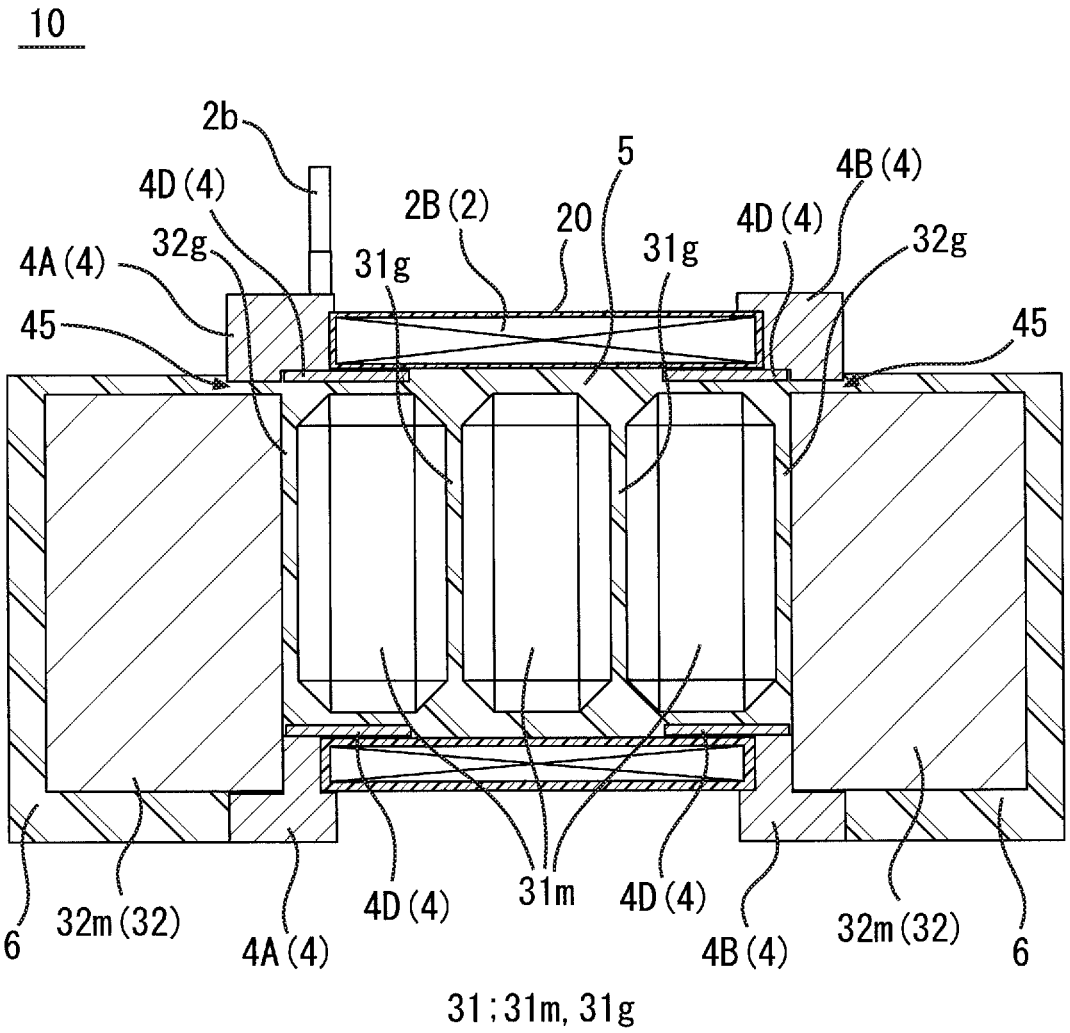
FIG. 2 is a cross-sectional view of the reactor taken along line II-II in FIG. 1.

The assembly 10, which includes the coil 2, the magnetic core 3, and the insulating connecting member 4, will be described mainly using an exploded perspective view in FIG. 3 and a schematic vertical cross-sectional view in FIG. 2. FIG. 2 shows side surfaces, not cross sections, of core pieces 31*m* (this also applies to FIG. 9).

Coil

Figure 3:
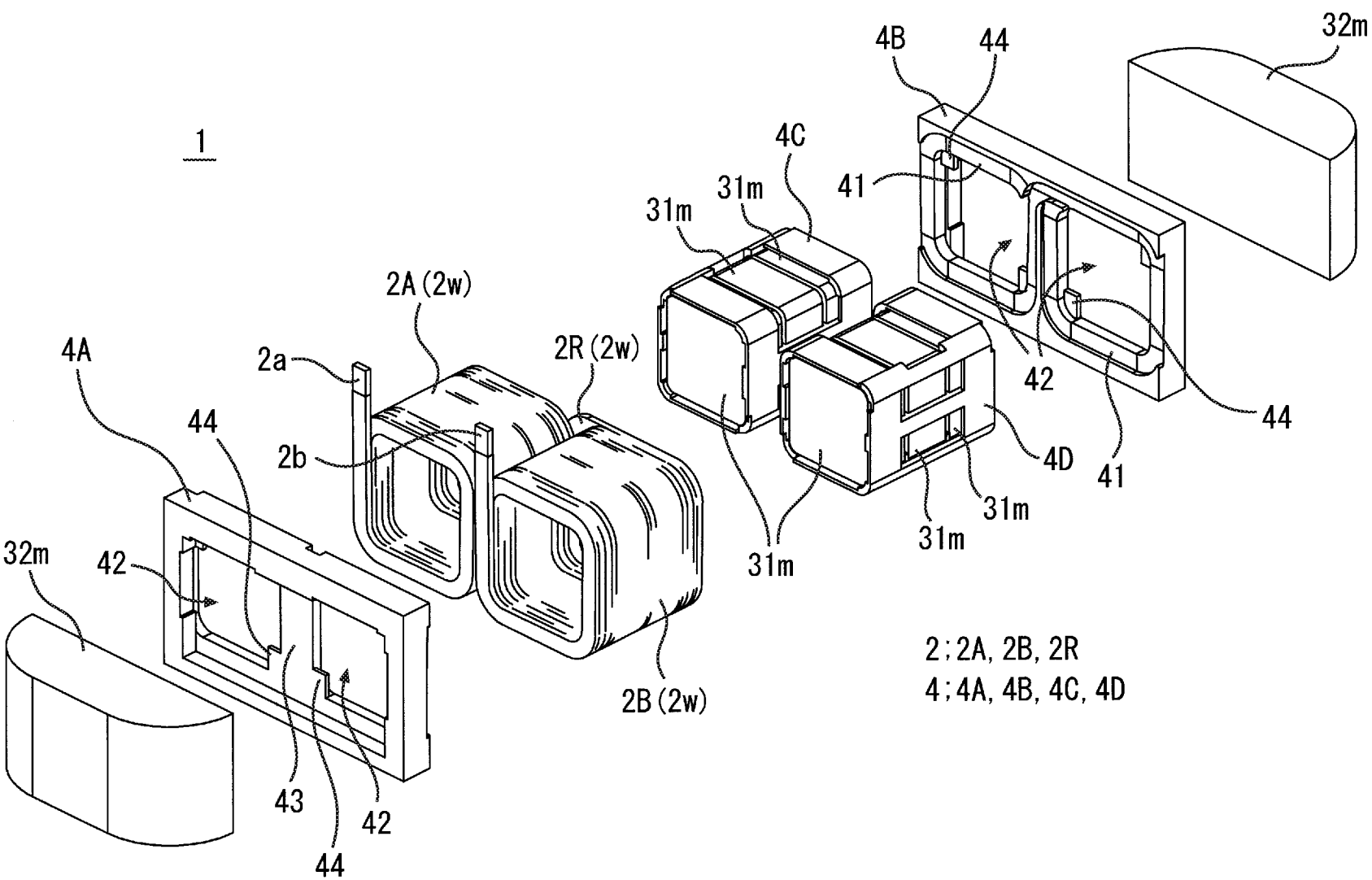
FIG. 3 is an exploded perspective view of an assembly, excluding inner resin portions and outer resin portions, described in Embodiment 1.

As shown in FIG. 3, the coil 2 of the present example is composed of a single wire 2*w* and includes a pair of wound portions 2A and 2B as well as a connecting portion 2R that connects the two wound portions 2A and 2B to each other. The wound portions 2A and 2B are formed into hollow tube shapes having the same number of turns and the same winding direction and are arranged side-by-side such that their axial directions are parallel to each other. The coil 2 may also be formed by connecting wound portions 2A and 2B that are produced using separate wires, to each other.

Each of the wound portions 2A and 2B of the present example is formed into a rectangular tube shape. The wound portions 2A and 2B having a rectangular tube shape refer to wound portions whose end surfaces have a quadrangular shape (including a square shape) with rounded corners. It goes without saying that the wound portions 2A and 2B may also be formed into a cylindrical tube shape. A cylindrical tube-shaped wound portion refers to a wound portion whose end surfaces have a closed curved shape (elliptical shape, perfect circle shape, racetrack shape, or the like).

The coil 2 including the wound portions 2A and 2B can be constituted by a coated wire including a conductor, such as a rectangular wire or a round wire, made of a conductive material, such as copper, aluminum, magnesium, or an alloy thereof, and an insulating coating made of an insulating material and provided on an outer periphery of the conductor. In the present embodiment, the wound portions 2A and 2B are formed by winding a coated rectangular wire edgewise, the coated rectangular wire being constituted by a rectangular wire (wire 2*w*) made of copper, which serves as a conductor, and an insulating coating made of an enamel (typically, polyamideimide).

Both end portions 2*a* and 2*b* of the coil 2 are drawn out from the wound portions 2A and 2B and are connected to respective terminal members, which are not shown. The insulating coating made of an enamel or the like is stripped from the end portions 2*a* and 2*b*. An external device such as a power supply that supplies power to the coil 2 is connected via the terminal members.

Preferably, the coil 2 having the above-described configuration is integrated by using a resin as shown in FIG. 2. In the case of the present example, the wound portions 2A and 2B of the coil 2 are each individually integrated by using an integrating resin 20. The integrating resin 20 of the present example is configured by fusion-bonding a coating layer that is formed on an outer periphery (outer periphery of the insulating coating made of an enamel or the like) of the wire and made of a thermally fusion-bondable resin, and is extremely thin. Therefore, even when the wound portions 2A and 2B are each integrated by using the integrating resin, the shapes of the turns, or the boundaries between the turns, of the wound portions 2A and 2B can be externally recognized. Examples of the material for the integrating resin 20 include resins that can be thermally fusion-bonded, for example, thermosetting resins such as epoxy resins, silicone resins, and unsaturated polyester.

The integrating resin 20 is shown in an exaggerated manner in FIG. 2, and is actually formed to be extremely thin. The integrating resin 20 integrates the turns that constitute the wound portion 2B (the same applies to the wound portion 2A), and suppresses expansion and contraction of the wound portion 2B in its axial direction. In the present example, the integrating resin 20 is formed by fusion-bonding a thermally fusion-bondable resin that is formed on the wire 2*w*, and therefore, the integrating resin 20 uniformly enters spaces between the turns. The thickness t1 of the integrating resin 20 between the turns is about twice the thickness of the thermally fusion-bondable resin that is formed on the surface of the wire 2*w* before being wound, and may specifically be not less than 20 μm and not more than 2 mm. A large thickness t1 allows the turns to be firmly integrated, while a small thickness t1 can suppress the axial length of the wound portion 2B from becoming excessively long.

Here, the rectangular tube-shaped wound portions 2A and 2B of the coil 2 each can be divided into four corner portions that are formed by bending the wire 2*w* and flat portions where the wire 2*w* is not bent. FIGS. 1 and 2 show a configuration in which, in both the corner portions and the flat portions of the wound portions 2A and 2B, the turns are integrated using the integrating resin 20. However, a configuration may also be adopted in which the turns are integrated using the integrating resin 20 in only a part, for example, the corner portions, of the wound portions 2A and 2B.

At the corner portions of the wound portions 2A and 2B, which are formed by winding the wire 2*w* edgewise, the inner side of the bends is likely to be thicker than the outer side of the bends. If the wound portions 2A and 2B in which the inner side of the bends is thick as described above are heat-treated to melt the thermally fusion-bondable resin on the surface of the wire 2*w*, the turns can be integrated using the integrating resin 20 on the inner side of the bends, while the turns can be separated from one another on the outer side of the bends. In this case, in the flat portions of the wound portions 2A and 2B, although the thermally fusion-bondable resin is present on the outer periphery of the wire 2*w*, the turns are separated from one another without being integrated. If spaces that are thus created in the flat portions are sufficiently small, even when a resin is filled into the inside of the wound portions 2A and 2B, the resin cannot pass through those spaces in the flat portions due to surface tension.

Magnetic Core

The magnetic core 3 is configured by combining a plurality of core pieces 31*m* and 32*m* together, and can be divided into inner core portions 31 and outer core portions 32 (see both of FIGS. 1 and 2) for the sake of convenience.

As shown in FIG. 2, an inner core portion 31 is a portion that is disposed inside the wound portion 2B (the same applies to the wound portion 2A) of the coil 2. Here, the inner core portions 31 mean those portions of the magnetic core 3 that extend along the axis of the respective wound portions 2A and 2B of the coil 2. For example, according to FIG. 2, end portions of the portions that extend along the axis of the respective wound portions 2A and 2B protrude past end surfaces of the wound portions 2A and 2B to the outside of the wound portions 2A and 2B, but these protruding portions also constitute part of the inner core portions 31.

The inner core portions 31 of the present example are each constituted by three core pieces 31*m*, gap portions 31*g* that are formed between the core pieces 31*m*, and gap portions 32*g* that are each formed between a corresponding one of the core pieces 31*m* and a core piece 32*m*, which will be described later. The gap portions 31*g* and 32*g* of the present example are formed of an inner resin portion 5, which will be described later. The shape of the inner core portion 31 is a shape that conforms to the inner shape of the wound portion 2A (2B), and is a substantially rectangular parallelepiped in the case of the present example.

On the other hand, the outer core portions 32 are those portions that are disposed outside the wound portions 2A and 2B, and each have a shape that connects end portions of the pair of inner core portions 31 (see FIG. 1). The outer core portions 32 of the present example are each composed of a core piece 32*m* having a column shape whose upper and lower surfaces are substantially dome-shaped. The lower surfaces (lower surfaces of the core pieces 32*m*) of the outer core portions 32 are substantially flush with lower surfaces of the wound portions 2A and 2B of the coil 2 (see FIG. 2).

Each of the core pieces 31*m* and 32*m* is a powder compact that is obtained by compression molding a raw material powder containing a soft magnetic powder. The soft magnetic powder is an aggregate of magnetic particles composed of an iron-group metal such as iron, an alloy thereof (a Fe—Si alloy, a Fe—Ni alloy, etc.), or the like. The raw material powder may also contain a lubricant. Unlike the present example, each of the core pieces 31*m* and 32*m* can also be composed of a molded body made of a composite material containing a soft magnetic powder and a resin. A soft magnetic powder and a resin that are the same as those that can be used in the powder compact can be used as the soft magnetic powder and the resin of the composite material. An insulating coating composed of a phosphate or the like may also be formed on the surface of the magnetic particles.

Here, the core pieces 31*m* of the present example have a characteristic shape that is different from conventional shapes. This characteristic shape will be described with reference to FIG. 4 (showing a portion of FIG. 2 in an enlarged manner). Each core piece 31*m* of the present example includes a pair of gap-facing surfaces 31X, as well as coil-facing surfaces 31Y that face an inner peripheral surface of the wound portion 2B (FIG. 2). The gap-facing surface 31X on the right side of the paper plane is a surface that faces the gap portion 31*g* that is formed between the core piece 31*m* and an adjacent core piece 31*m*, and the gap-facing surface 31X on the left side of the paper plane is a surface that faces the gap portion 32*g* that is formed between the core piece 31*m* and a core piece 32*m* (outer core portion 32). The core piece 31*m* of the present example further includes notch-shaped resin flow portions 31Z that are provided at corner portions between each gap-facing surface 31X and the coil-facing surfaces 31Y. The resin flow portions 31Z may be inclined surfaces such as those shown in the drawings, or may be curved surfaces. Since these resin flow portions 31Z are provided, it is less likely that a large air gap will be formed in the gap portions 31*g* and 32*g*. Actually, no large air gap is formed in the gap portions 31*g* and 32*g* of the present example. The mechanism of air gap suppression exhibited by the resin flow portions 31Z will be described in the section of Method for Manufacturing Reactor.

Figure 4:
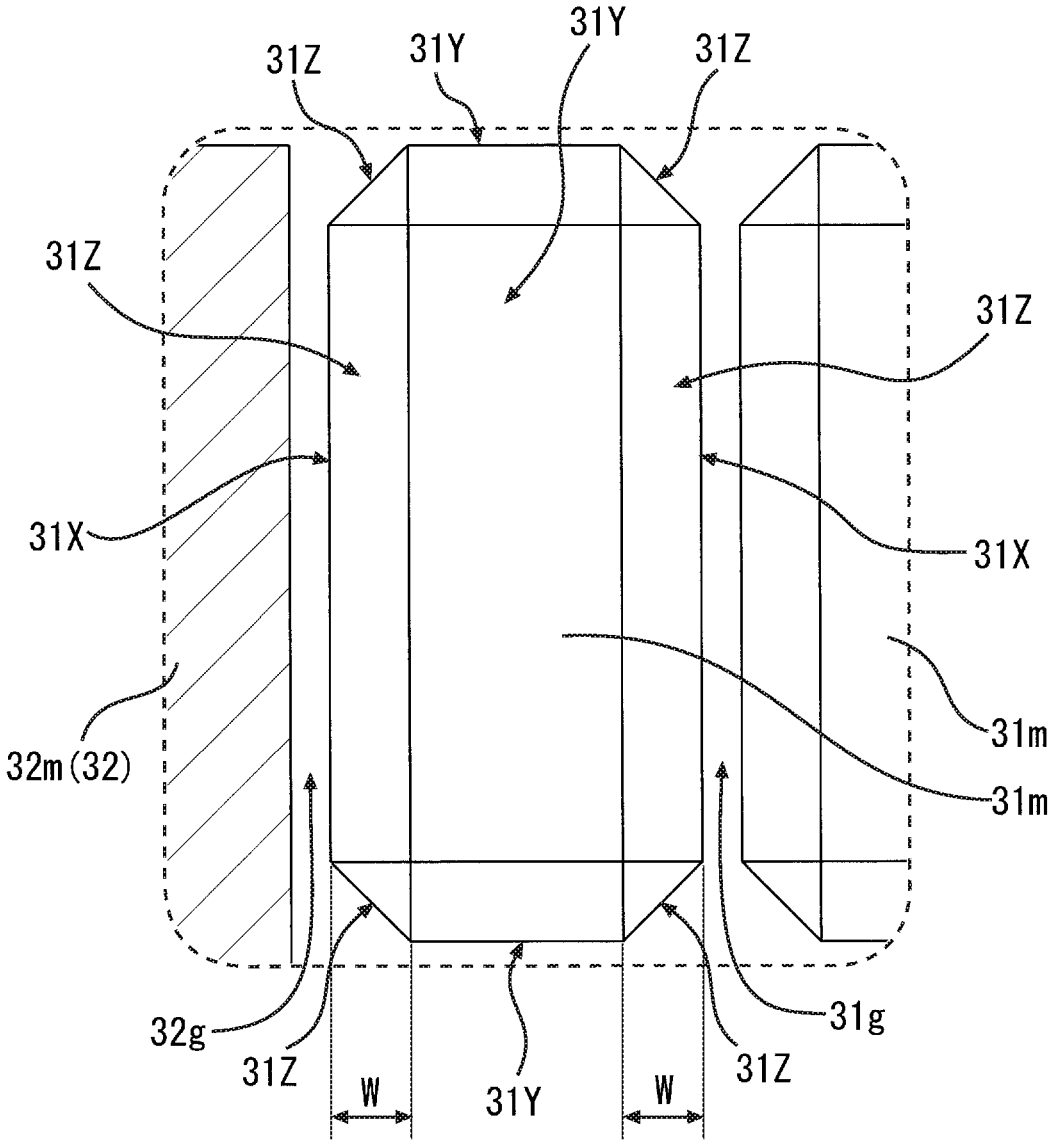
FIG. 4 shows a portion of FIG. 2 in an enlarged manner.
Figure 6:
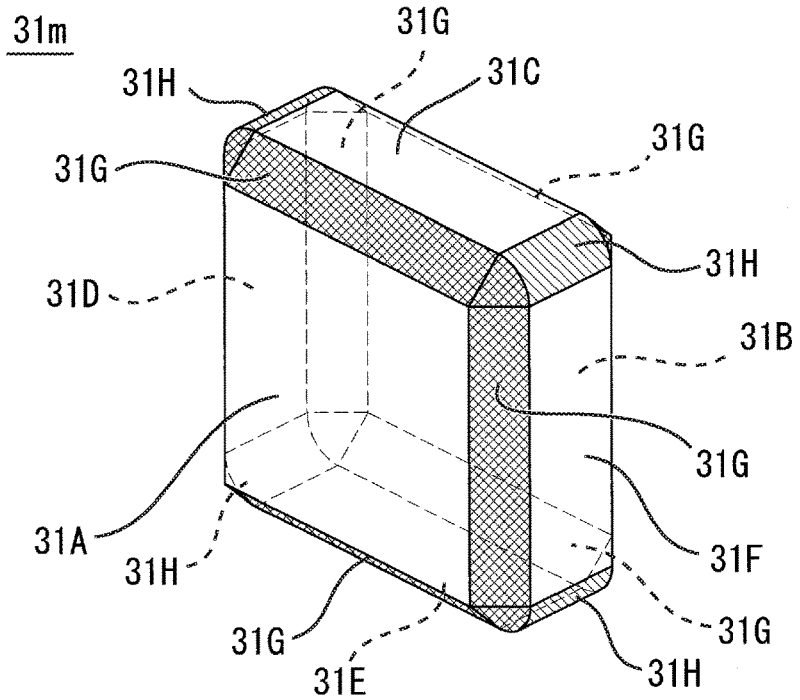
FIG. 6 is a schematic perspective view showing a core piece that constitutes an inner core portion described in Embodiment 1.

Next, an overall shape of each core piece 31*m* having the resin flow portions 31Z will be described based on FIG. 6. The core piece 31*m* in FIG. 6 has a substantially rectangular parallelepiped shape, and includes flat surfaces 31A and 31B that are parallel to each other as well as four peripheral surfaces 31C to 31F. When the flat surface 31A (31B) is viewed from the front, the core piece 31*m* has an inclined portion 31G that is formed running all the way around an outer peripheral edge portion of the flat surface 31A (31B) and that is inclined toward the peripheral surfaces 31C to 31F (see cross-hatched portion). Moreover, the core piece 31*m* has rounded portions 3111 that are formed (indicated by oblique hatching at 135°) by rounding ridges between the peripheral surfaces 31C and 31D (31D and 31E) (31E and 31F) (31F and 31C) that are adjacent to each other in a peripheral direction. In FIGS. 2 and 4, the core pieces 31*m* each having this configuration are lined up such that their flat surfaces 31A (31B) constitute the gap-facing surfaces 31X. That is to say, the inclined portions 31G of the core pieces 31*m* function as the resin flow portions 31Z in FIG. 4. The inclined portions 31G may also have a curved shape.

Figure 7:
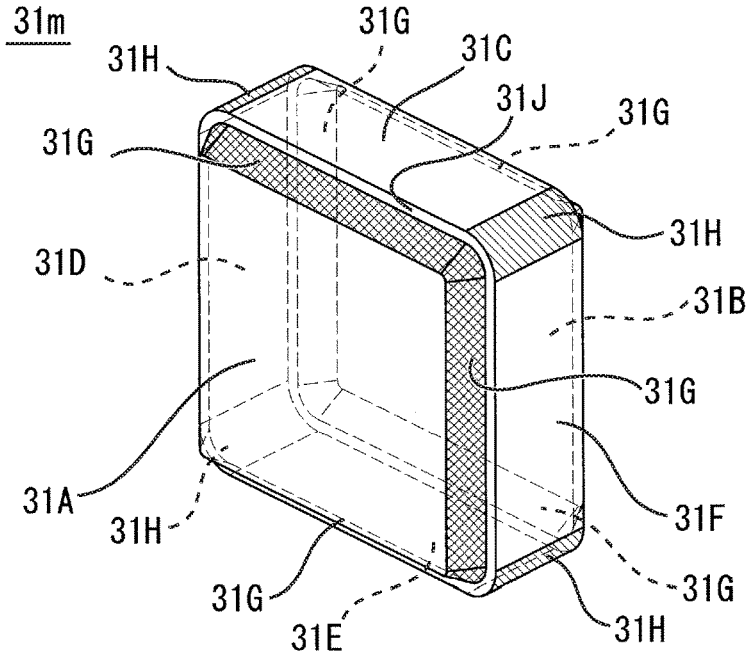
FIG. 7 is a schematic perspective view of a core piece having a different form than that in FIG. 6.

It is also possible to use core pieces 31*m* with a shape shown in FIG. 7 as the core pieces 31*m* of the reactor 1. As is the case with the core piece 31*m* in FIG. 6, the core piece 31*m* in FIG. 7 includes the flat surfaces 31A and 31B, the peripheral surfaces 31C to 31F, the inclined portions 31G, and the rounded portions 3111. This core piece 31*m* further includes loop-shaped portions 31J that connect the respective inclined portions 31G to the peripheral surfaces 31C to 31F. The loop-shaped portions 31J are provided parallel to the flat surface 31A (31B).

Insulating Connecting Member

As shown in FIGS. 2 and 3, the insulating connecting member 4 is a member that ensures insulation between the coil 2 and the magnetic core 3, and is constituted by end surface connecting members 4A and 4B as well as inner connecting members 4C and 4D. The insulating connecting member 4 can be composed of, for example, thermoplastic resins such as polyphenylene sulfide (PPS) resins, polytetrafluoroethylene (PTFE) resins, liquid crystal polymers (LCPs), polyamide (PA) resins such as nylon 6 and nylon 66, polybutylene terephthalate (PBT) resins, and acrylonitrile-butadiene-styrene (ABS) resins. In addition, the insulating connecting member 4 can be formed of thermosetting resins such as unsaturated polyester resins, epoxy resins, urethane resins, and silicone resins. It is also possible to improve the heat dissipation properties of the insulating connecting member 4 by mixing a ceramic filler into the above-described resins. For example, a non-magnetic powder such as alumina or silica can be used as the ceramic filler.

End Surface Connecting Members

The end surface connecting members 4A and 4B will be described mainly using FIG. 3. Two turn accommodating portions 41 that accommodate at least a part of axial end portions of the wound portions 2A and 2B, respectively, are formed in a coil-side face of each of the end surface connecting members 4A and 4B (the turn accommodating portions of the end surface connecting member 4A are located at positions that cannot be seen). The turn accommodating portions 41 are formed in order to bring the entire axial end surface of each of the wound portions 2A and 2B into surface contact with the end surface connecting member 4A. More specifically, each turn accommodating portion 41 is formed in a quadrangular loop shape that surrounds the perimeter of a through hole 42, which will be described later, and has projections and depressions that correspond to projections and depressions of the end surface of a corresponding one of the wound portions 2A and 2B. The turn accommodating portions 41 bring the axial end surfaces of the wound portions 2A and 2B into surface contact with the end surface connecting member 4A, thereby making it possible to suppress leakage of the resin from the contact portions.

The end surface connecting members 4A and 4B each also include a pair of through holes 42 and a fitting portion 43 (see the end surface connecting member 4A), in addition to the above-described turn accommodating portions 41. The through holes 42 are holes into which respective assemblies of the inner connecting members 4C and 4D and the core pieces 31*m* are to be fitted. On the other hand, the fitting portion 43 is a recess into which a corresponding one of the core pieces 32*m* that constitute the outer core portions 32 is to be fitted.

Abutment portions 44 that are to be abutted to and stop the above-described assembly are formed in a lower portion near the middle and a laterally outer upper portion, respectively, of each of the above-described through holes 42. Due to the abutment portions 44, the assemblies are separated from the core pieces 32*m* without coming into direct contact therewith.

Figure 5:
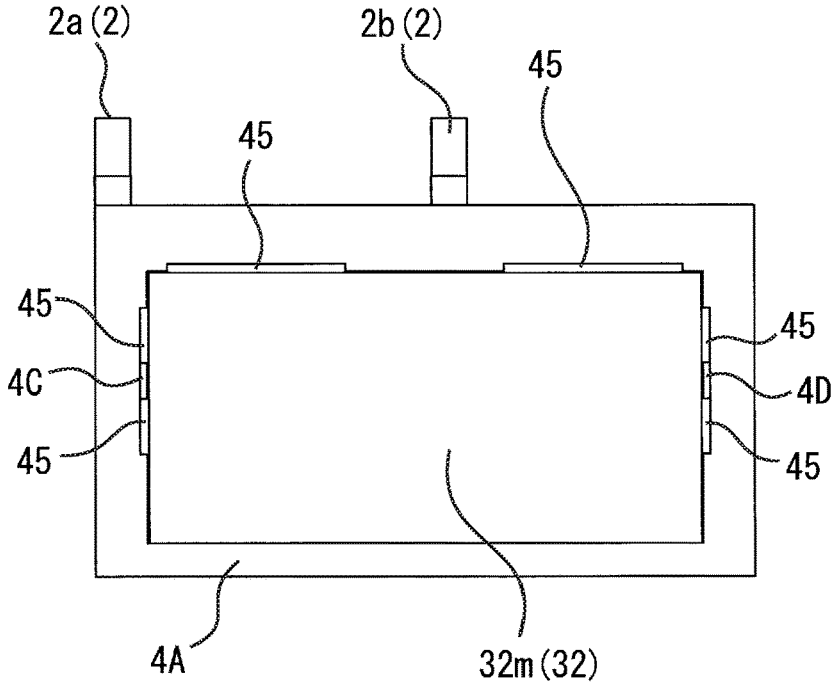
FIG. 5 is a schematic front view of the assembly shown in Embodiment 1 before the inner resin portions and the outer resin portions are formed.

A lateral portion and an upper portion of each through hole 42 protrude outward. As shown in FIG. 5, when the core piece 32*m* is fitted in the fitting portion 43 (FIG. 3) of the end surface connecting member 4A, the protruding portions form resin filling ports 45 at positions on lateral edges and an upper edge of the core piece 32*m*. The resin filling ports 45 are openings that penetrate the end surface connecting member 4A in the thickness direction from the outer core portion 32 (core piece 32*m*) side, which is the front side of the paper plane, toward the axial end surfaces of the wound portions 2A and 2B, which are on the back side of the paper plane, and are each in communication with a space between the inner peripheral surface of the wound portion 2A or 2B and the outer peripheral surface of the inner core portion 31 (core pieces 31*m*), on the back side of the paper plane (see also FIG. 2).

Inner Connecting Members

The inner connecting members 4C and 4D are not limited as long as these members can keep the distances between adjacent core pieces 31*m* at a predetermined value and the distances from the core pieces 31*m* to the inner peripheral surface of the wound portion 2A or 2B at a predetermined value during filling of the resin that is to constitute the inner resin portion 5, which will be described later, into the wound portions 2A and 2B. For example, the inner connecting members 4C and 4D of the present example are basket-like members having the same shape, and when the inner connecting member 4C is rotated 180° in a horizontal direction, the inner connecting member 4C coincides with the inner connecting member 4D. The inside of each of the inner connecting members 4C and 4D is divided into three portions in the axial direction, and the core pieces 31*m* can be accommodated in the respective divided portions. In each of the inner connecting members 4C and 4D, the core pieces 31*m* accommodated therein are separated from one another.

Inner Resin Portions

As shown in FIG. 2, the inner resin portion 5 is disposed inside the wound portion 2B (the same applies to the wound portion 2A, which is not shown), and joins the inner peripheral surface of the wound portion 2B to the outer peripheral surfaces of the core pieces 31*m* (inner core portion 31).

Since the wound portion 2B is integrated using the integrating resin 20, the inner resin portion 5 is limited to the inside of the wound portion 2B without extending to a space between the inner and outer peripheral surfaces of each turn of the wound portion 2B. Moreover, a portion of the inner resin portion 5 enters between the core pieces 31*m* and also between the core pieces 31*m* and 32*m* to form the gap portions 31*g* and 32*g*.

With regard to the inner resin portions 5, for example, thermosetting resins such as epoxy resins, phenolic resins, silicone resins, and urethane resins, thermoplastic resins such as PPS resins, PA resins, polyimide resins, and fluororesins, normal-temperature curing resins, or low-temperature curing resins can be used. It is also possible to improve the heat dissipation properties of the inner resin portions 5 by mixing a ceramic filler such as alumina or silica into these resins. Preferably, the inner resin portions 5 are composed of the same material as the end surface connecting members 4A and 4B and the inner connecting members 4C and 4D. When the three types of members are composed of the same material, the three types of members can have the same coefficient of linear expansion, and damage to the members due to thermal expansion and contraction can be suppressed.

Outer Resin Portions

As shown in FIGS. 1 and 2, the outer resin portions 6 are disposed so as to cover the entire outer periphery of the respective core pieces 32*m* (outer core portions 32), and the outer resin portions 6 fix the core pieces 32*m* to the corresponding end surface connecting members 4A and 4B while protecting the core pieces 32*m* from the external environment. Here, the lower surfaces of the core pieces 32*m* may be exposed from the outer resin portions 6. In that case, it is preferable that lower portions of the core pieces 32*m* are extended so as to be substantially flush with the lower surfaces of the end surface connecting members 4A and 4B. The heat dissipation properties of the magnetic core 3 including the core pieces 32*m* can be enhanced by bringing the lower surfaces of the core pieces 32*m* into direct contact with the mount plate 9, which will be described later, or disposing an adhesive or an insulating sheet between the mount plate 9 and the lower surfaces of the core pieces 32*m*.

The outer resin portions 6 of the present example are provided on a side of the corresponding end surface connecting members 4A and 4B where the core piece 32*m* is disposed, and do not extend to the outer peripheral surfaces of the wound portions 2A and 2B. Considering the function of the outer resin portions 6 of fixing and protecting the core pieces 32*m*, it can be said that a formation range of the outer resin portions 6 shown in the drawings is sufficient and is preferable in that the amount of resin that is used can be reduced. It goes without saying that, unlike the example shown in the drawings, the outer resin portions 6 may extend to the wound portions 2A and 2B.

As shown in FIG. 2, the outer resin portions 6 of the present example are connected to the inner resin portions 5 via the resin filling ports 45 of the end surface connecting members 4A and 4B. That is to say, the outer resin portions 6 and the inner resin portions 5 are formed at one time using the same resin. It is also possible that, unlike the present example, the outer resin portions 6 and the inner resin portions 5 are separately formed. The outer resin portions 6 can be composed of a resin that is similar to a resin that can be used to form the inner resin portions 5. In the case where the outer resin portions 6 are connected to the inner resin portions 5 as in the present example, the resin portions 6 and 5 are composed of the same resin.

In addition, as shown in FIG. 1, fixing portions 60 (see FIG. 1) for fixing the assembly 10 to the mount plate 9 or the like is formed in the outer resin portions 6. For example, fixing portions 60 for bolting the assembly 10 to the mount plate 9 can be formed by embedding collars composed of a highly rigid metal or resin into the outer resin portions 6.

Mount Plate

As shown in FIG. 1, the reactor 1 of the present embodiment further includes the mount plate 9 on which the assembly 10 is mounted. A joint layer 8 for joining the mount plate 9 and the assembly 10 to each other is formed between the mount plate 9 and the assembly 10. The mount plate 9 is preferably composed of a material that has excellent mechanical strength and thermal conductivity, and can be composed of, for example, aluminum or an aluminum alloy. The joint layer 8 is preferably composed of a material that has excellent insulating properties, and can be composed of, for example, a thermosetting resin such as an epoxy resin, a silicone resin, or an unsaturated polyester, or a thermosetting resin such as a PPS resin or an LCP. It is also possible to improve the heat dissipation properties of the joint layer 8 by mixing a ceramic filler or the like into these insulating resins.

Method for Manufacturing Reactor

Next, an example of a method for manufacturing a reactor that is used to manufacture the reactor 1 according to Embodiment 1 will be described. Roughly speaking, the method for manufacturing a reactor includes the following steps. The method for manufacturing a reactor will be described with reference mainly to FIG. 3.

Coil producing step
Integrating step
Assembling step
Filling step
Curing step

Coil Producing Step

In this step, the wire 2*w* is prepared, and a portion of the wire 2*w* is wound to produce the coil 2. A known winding machine can be used to wind the wire 2*w*. A coating layer that is composed of a thermally fusion-bondable resin and that constitutes the integrating resin 20, which has been described with reference to FIG. 2, can be formed on the outer periphery of the wire 2*w*. The thickness of the coating layer can be selected as appropriate.

Integrating Step

In this step, the wound portions 2A and 2B of the coil 2 that has been produced in the coil producing step are integrated using the integrating resin 20 (see FIG. 2). In the case where the coating layer composed of a thermally fusion-bondable resin is formed on the outer periphery of the wire 2*w*, the integrating resin 20 can be formed by heat-treating the coil 2. On the other hand, in the case where no coating layer is formed on the outer periphery of the wire 2*w*, the integrating resin 20 can be formed by applying a resin to the outer periphery or the inner periphery of the wound portions 2A and 2B of the coil 2 and curing the resin. This integrating step can also be performed after the assembling step, which will be described next, and prior to the filling step.

Assembling Step

In this step, the coil 2, the core pieces 31*m* and 32*m* that constitute the magnetic core 3, and the insulating connecting member 4 are combined together. For example, first assemblies are produced in which the core pieces 31*m* are disposed in the accommodating portions of the inner connecting members 4C and 4D, and the first assemblies are disposed inside the respective wound portions 2A and 2B. Then, the end surface connecting members 4A and 4B are placed abutting against the end surfaces on one axial end side and the end surfaces on the other axial end side, respectively, of the wound portions 2A and 2B and are together sandwiched between the pair of core pieces 32*m* to produce a second assembly in which the coil 2, the core pieces 31*m* and 32*m*, and the insulating connecting member 4 are combined together.

Here, as shown in FIG. 5, when the second assembly is viewed in the axial direction of the wound portions 2A and 2B of the coil 2, the resin filling ports 45 through which the resin is filled into the inside of the wound portions 2A and 2B are formed at the lateral edge and the upper edge of each core piece 32*m* (outer core portion 32). The resin filling ports 45 are formed by spaces created by the through holes 42 of the end surface connecting members 4A and 4B with the outer core portions 32 fitted in the respective fitting portions 43 (see also FIG. 3).

Filling Step

In the filling step, a resin is filled into the inside of the wound portions 2A and 2B of the second assembly. In the present example, injection molding is performed in which the second assembly is placed in a mold, and the resin is injected into the mold. The resin is injected from an end surface side (opposite side to the coil 2) of either one of the core pieces 32*m*. The resin that has been filled into the mold covers the outer peripheries of the core pieces 32*m* and flows into the inside of the wound portions 2A and 2B via the resin filling ports 45 (FIGS. 2 and 5). At this time, air in the wound portions 2A and 2B is discharged to the outside from the resin filling ports 45 on the other core piece 32*m* side.

As shown in FIG. 2, the resin that is filled into the inside the wound portions 2A and 2B enters not only spaces between the inner peripheral surface of the wound portion 2B and the outer peripheral surfaces of the core pieces 31*m* but also spaces between two adjacent core pieces 31*m* and spaces between the core pieces 31*m* and the corresponding outer core portions 32 (core pieces 32*m*), thereby forming the gap portions 31*g* and 32*g*. Here, as shown in FIG. 4, since the resin flow portions 31Z are formed on the core pieces 31*m* of the present example, the resin can easily enter the spaces between the core pieces 31*m* as well as the spaces between the core pieces 31*m* and the corresponding core pieces 32*m*. Thus, the spaces are sufficiently filled with the resin, and a large air gap is less likely to be formed or not formed at all in the gap portions 31*g* and 32*g*. As shown in FIG. 4, setting the width W of the resin flow portions 31Z to be larger than the distance between the core pieces 31*m* and 31*m* (31*m* and 32*m*), which constitute the gap portions 31*g* (32*g*), makes it easy for the resin to penetrate the spaces between the core pieces 31*m* and 31*m* (31*m* and 32*m*), which constitute the gap portions 31*g* (32*g*).

The resin that has been filled into the inside the wound portions 2A and 2B via the resin filling ports 45 under pressure applied through injection molding sufficiently spreads all through the narrow spaces between the wound portions 2A and 2B and the corresponding inner core portions 31, but hardly leaks to the outside of the wound portions 2A and 2B. The reason for this is that, as shown in FIG. 2, the axial end surfaces of the wound portion 2B are in surface contact with the respective end surface connecting members 4A and 4B, and the wound portion 2B is integrated using the integrating resin 20.

Here, as already stated in the description of the wound portions 2A and 2B, in the case where the coil 2 in which the turns at the corner portions of the rectangular tube-shaped wound portions 2A and 2B are integrated and minute spaces are formed in the flat portions is used, the resin can be filled from both the outside of one of the core pieces 32*m* and the outside of the other of the core pieces 32*m*. In this case, air is discharged from the minute spaces formed in the flat portions to the outside of the wound portions 2A and 2B. Due to the viscosity and surface tension of the resin, the resin hardly leaks to the outside of the wound portions 2A and 2B from the minute spaces in the flat portions.

Curing Step

In the curing step, the resin is cured through heat treatment, or cures over time, for example. The portions of the cured resin that are present inside the wound portions 2A and 2B constitute the inner resin portions 5 as shown in FIG. 2, and the portions of the cured resin that cover the core pieces 32*m* constitute the outer resin portions 6.

According to the above-described method for manufacturing a reactor, the assembly 10 of the reactor 1 shown in FIG. 1 can be manufactured. Since the inner resin portions 5 and the outer resin portions 6 are integrally formed, it is sufficient that the filling step and the curing step are performed only once, and therefore, the assembly 10 can be manufactured with high productivity. The completed assembly 10 can be fixed to the mount plate 9 via the joint layer 8.

Effects of Reactor

In the reactor 1 of the present example, since the resin flow portions 31Z are formed on the core pieces 31*m*, no large air gap is formed in the gap portions 31*g* and 32*g*. Therefore, looseness of the inner core portions 31 inside the wound portions 2A and 2B can be suppressed, and the occurrence of noise and the contact of the wound portions 2A and 2B with the inner core portions 31 can be suppressed.

Moreover, in the reactor 1 of the present example, the outer peripheries of the wound portions 2A and 2B of the coil 2 are not molded with resin and are directly exposed to the external environment, so that the reactor 1 of the present example is a reactor 1 that has excellent heat dissipation properties. The heat dissipation properties of the reactor 1 can be improved even more if a configuration is adopted in which the assembly 10 of the reactor 1 is immersed in a liquid coolant.

Embodiment 2

In Embodiment 2, a reactor 1 in which the core pieces 31*m* are connected together in a manner different from that of Embodiment 1 will be described based on FIGS. 8 and 9.

Figure 8:
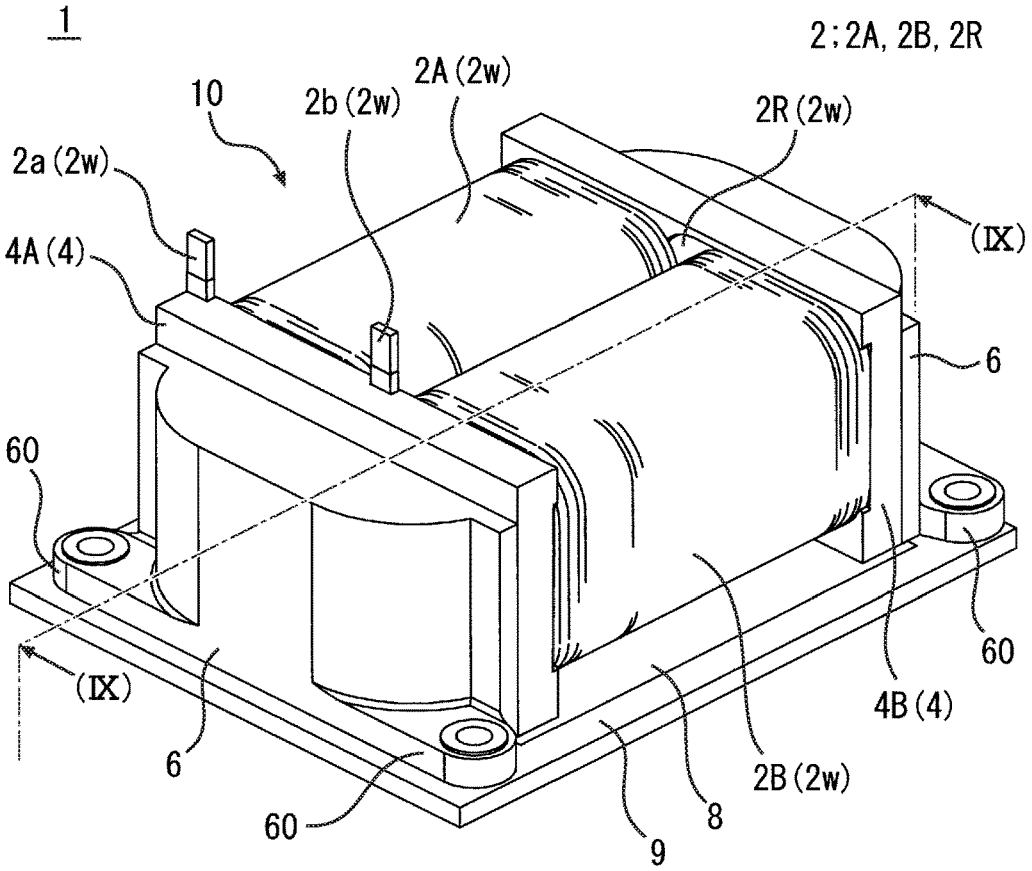
FIG. 8 is a schematic perspective view of a reactor according to Embodiment 2.
Figure 9:
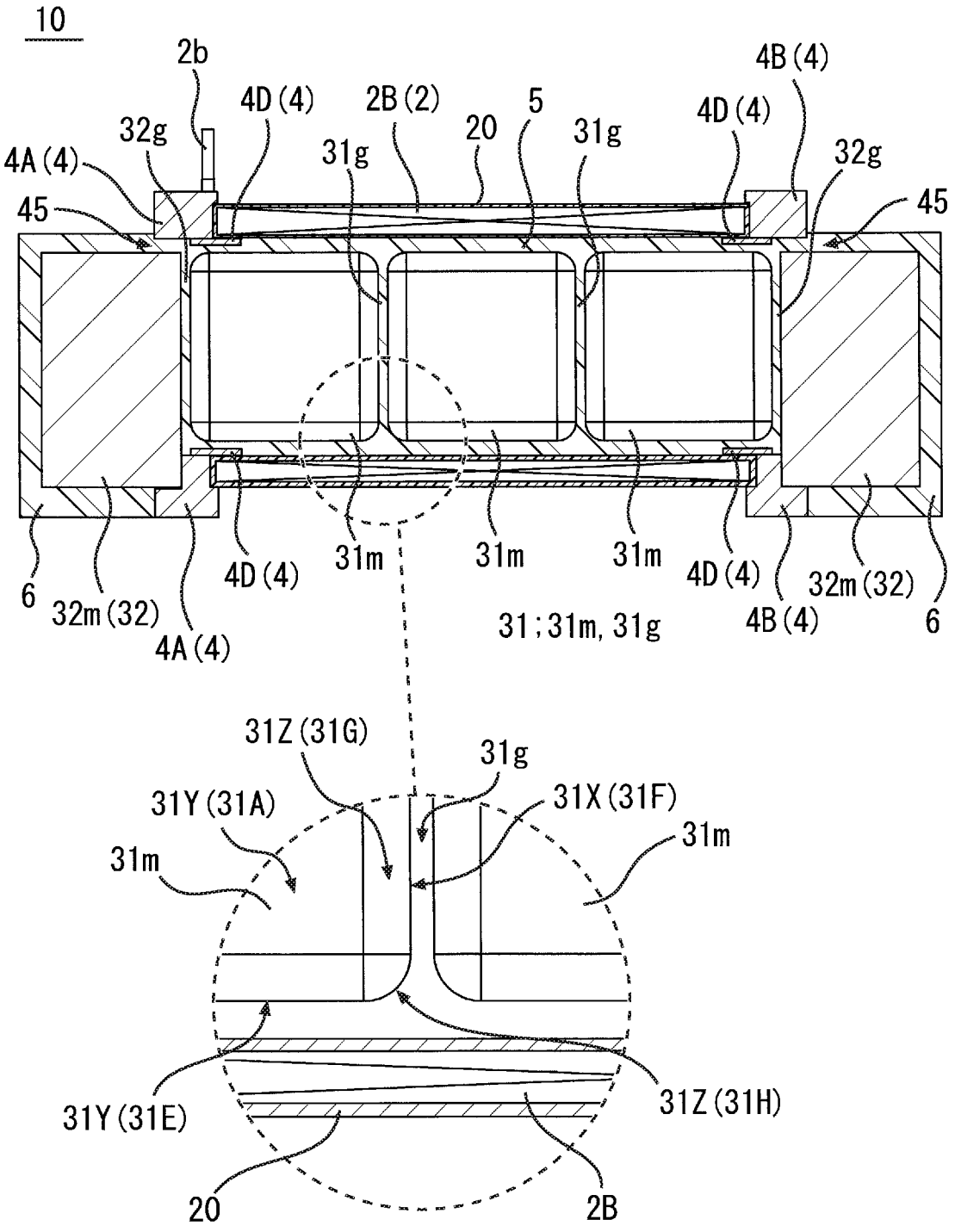
FIG. 9 is a cross-sectional view of the reactor taken along line IX-IX in FIG. 8.

As shown in FIG. 8, the reactor 1 of Embodiment 2 includes wound portions 2A and 2B whose axial length is longer than that of the wound portions 2A and 2B of the reactor 1 of Embodiment 1. In this reactor 1 of Embodiment 2, as shown in the partially cross-sectional view in FIG. 9, an inner core portion 31 is formed by connecting the core pieces 31*m* side-by-side, and these core pieces 31*m* have a larger thickness than the core piece 31*m* in FIG. 6. More specifically, as shown in an enlarged view in the circular inset of FIG. 9, the core pieces 31*m* are lined up such that the flat surfaces 31A of the core pieces 31*m* are oriented in a direction (front side of the paper plane) that is orthogonal to the axial direction of the wound portion 2B (see also FIG. 6). With this configuration, the peripheral surface 31F of the core piece 31*m* serves as the gap-facing surface 31X that faces the gap portion 31*g*, and the flat surface 31A and the peripheral surface 31E serve as the coil-facing surfaces 31Y. Also, the resin flow portions 31Z are formed by the inclined portions 31G and the rounded portions 3111.

In the reactor 1 of Embodiment 2, it is also possible to use core pieces 31*m* that are obtained by increasing the thickness of the core pieces 31*m* in FIG. 7.

Uses of Reactors of Embodiments

Reactors according to the embodiments can be used as a constituent member of power conversion devices such as bidirectional DC-DC converters installed in electric vehicles such as hybrid automobiles, electric automobiles, and fuel-cell electric automobiles.

LIST OF REFERENCE NUMERALS

1: Reactor
10: Assembly
2: Coil; 2*w*: Wire
  2A, 2B: Wound portion; 2R: Connecting portion; 2*a*, 2*b*: End portion
  20: Integrating resin
3: Magnetic Core
  31: Inner core portion; 32: Outer core portion
  31*m*, 32*m*: Core piece; 31*g*, 32*g*: Gap portion
  31X: Gap-facing surface; 31Y: Coil-facing surface; 31Z: Resin flow portion
  31A, 31B: Flat surface; 31C, 31D, 31E, 31F: Peripheral surface
  31G: Inclined portion; 3111: Rounded portion; 31J: Loop-shaped portion
4: Insulating connecting member
  4A, 4B: End surface connecting member
    41: Turn accommodating portion; 42: Through hole; 43: Fitting portion; 44: Abutment portion
  45: Resin filling port
  4C, 4D: Inner connecting member
5: Inner resin portion
6: Outer resin portion; 60: Fixing portion
8: Joint layer
9: Mount plate

The invention claimed is:

1. A reactor comprising:

a coil having a wound portion that is formed by winding a wire;

a magnetic core having an inner core portion that is disposed inside the wound portion and an outer core portion that is disposed outside the wound portion, the inner core portion and the outer core portion forming a closed magnetic circuit together; and an inner resin portion that joins an inner peripheral surface of the wound portion and an outer peripheral surface of the inner core portion to each other, wherein the inner core portion includes a plurality of core pieces that are arranged along an axial direction of the wound portion, and gap portions between the core pieces and between a corresponding one of the core pieces and the outer core portion, the gap portions being constituted by a portion of the inner resin portion, the core pieces each including:

a gap-facing surface that faces a corresponding one of the gap portions;

a coil-facing surface that faces the inner peripheral surface of the wound portion; and a notch-shaped resin flow portion that is provided at a corner portion between the gap-facing surface and the coil-facing surface, the notch-shaped resin flow portion is formed running all the way around an outer peripheral edge portion of the gap-facing surface, and when viewed in a direction that is orthogonal to an axial direction of the wound portion, a width of the notch-shaped resin flow portion is larger than a width of the gap portions.

2. The reactor according to claim 1, wherein the coil includes an integrating resin that is provided separately from the inner resin portion and that integrates wire turns of the wound portion.

3. The reactor according to claim 1, wherein the core pieces are each composed of a powder compact made of a soft magnetic powder.

4. The reactor according to claim 1, wherein the core pieces are each composed of a composite material containing a resin and a soft magnetic powder dispersed in the resin.

* * * * *